United States Patent [19]

Kishi et al.

[11] Patent Number: 4,989,532

[45] Date of Patent: Feb. 5, 1991

[54] LOCKING DEVICE FOR STEERING MAST OF SMALL WATERCRAFT

[75] Inventors: Hideki Kishi; Muneaki Kago, both of Iwata, Japan

[73] Assignee: Yamaha Hatsudoki Kabushiki Kaisha, Iwata, Japan

[21] Appl. No.: 400,482

[22] Filed: Aug. 30, 1989

[30] Foreign Application Priority Data

Aug. 30, 1988 [JP] Japan ..... 63-216770
Aug. 30, 1988 [JP] Japan ..... 63-216771

[51] Int. Cl.[5] ..... B63B 35/73
[52] U.S. Cl. ..... 114/270; 114/144.00 R
[58] Field of Search ..... 114/270, 144 R, 160; 74/480 B, 493

[56] References Cited

U.S. PATENT DOCUMENTS 3,168,156 2/1965 Ulinski ..... 74/493 X
3,826,220 7/1974 Jacobson ..... 114/270

FOREIGN PATENT DOCUMENTS 60-121993 8/1985 Japan .

*Primary Examiner*—Sherman Basinger
*Attorney, Agent, or Firm*—Ernest A. Beutler

[57] ABSTRACT

A U-shaped locking element having parallel extending ends is provided for selectively locking a raisable steering mast of a small watercraft in an upright position for servicing and maintaining the engine. The raisable steering mast is pivotally connected to a mounting transversely secured to the hull of the watercraft for movement between an upright position and a substantially horizontal lower position. The locking element is pivotally connected to a lug on the mounting for movement between a locked position, wherein the locking element engages with the steering mast while it is in the upright position to lock the steering mast in that position, and an unlocked position. At least one torsional spring is provided to urge the steering mast upward and thereby assist in raising the steering mast so that it can be locked in its upright position.

11 Claims, 5 Drawing Sheets

LOCKING DEVICE FOR STEERING MAST OF SMALL WATERCRAFT

BACKGROUND OF THE INVENTION

This invention relates to a locking device for a small watercraft. More particularly, the invention pertains to a locking device pivotally connected to a mounting on the hull of the watercraft for selectively locking the steering mast in an upright position for servicing and maintaining the engine.

Various types of small watercraft have been provided which include a raisable steering mast pivotally secured to the watercraft for movement between a substantially horizontal position and an upright position. Such watercraft typically have steering means supported on the upper end of the steering mast for steering the watercraft when the mast is in either of these positions or any position in between. These masts have been arranged so that when the watercraft is being operated with the steering mast in an upward and rearwardly extending position and the operator is inadvertently displaced from the watercraft, the steering mast, as a result of its weight, automatically pivots to its substantially horizontal position.

Previous watercraft steering masts have also been arranged so that they could be pivoted to an upright and slightly forwardly extending position so that the steering masts could be propped up using a rod pivotally secured to the front portion of the nose of the watercraft near the bow. An example of such an arrangement is set forth in Japanese Patent No. 60-121993.

The present invention is designed to eliminate the need for a rod to maintain the steering mast in an upright position and thereby provide a neater appearance for the watercraft. It is a further object of this invention to provide a compact locking device pivotally connected to a mounting on the hull for locking the steering mast of a small watercraft in an upright position for servicing the engine.

SUMMARY OF THE INVENTION

A first embodiment of the invention includes locking means, preferably in the form of a U-shaped locking element having parallel extending ends, pivotally connected to a mounting secured to the hull for selectively locking the raisable steering mast of a small watercraft in an upright position for convenient servicing of the engine, which is located in the hull of the watercraft beneath the steering mast. In the preferred embodiment, biasing means, preferably comprising at least one torsional spring, is provided for biasing the steering mast against the hull to assist in raising the steering mast so that it can be locked in its upright position.

A second embodiment of the invention further includes a keeper engageable with the locking means when the raisable steering mast and locking means are in the unlocked position.

A typical small watercraft for which the invention is adapted includes a hull having a stern, a bow, a horizontal platform and a removable hood that cooperatively define an operator space near the stern of the watercraft. Propulsion means are provided and carried in the hull for propelling the watercraft through the water. The propulsion means includes an engine, usually of the internal combustion type, typically located forwardly of the operator space.

The raisable steering mast has a lower portion pivotally connected to the mounting secured to the hull for movement between an upright position and a substantially horizontal lower position. Steering means are associated with the steering mast and are operable when the steering mast is in an upward position by an operator standing in the operator space. The steering means are used to effect movement of a steerable discharge nozzle to steer the watercraft.

DETAILED DESCRIPTION OF THE PREFERRED EMBODIMENTS

Figure 1:
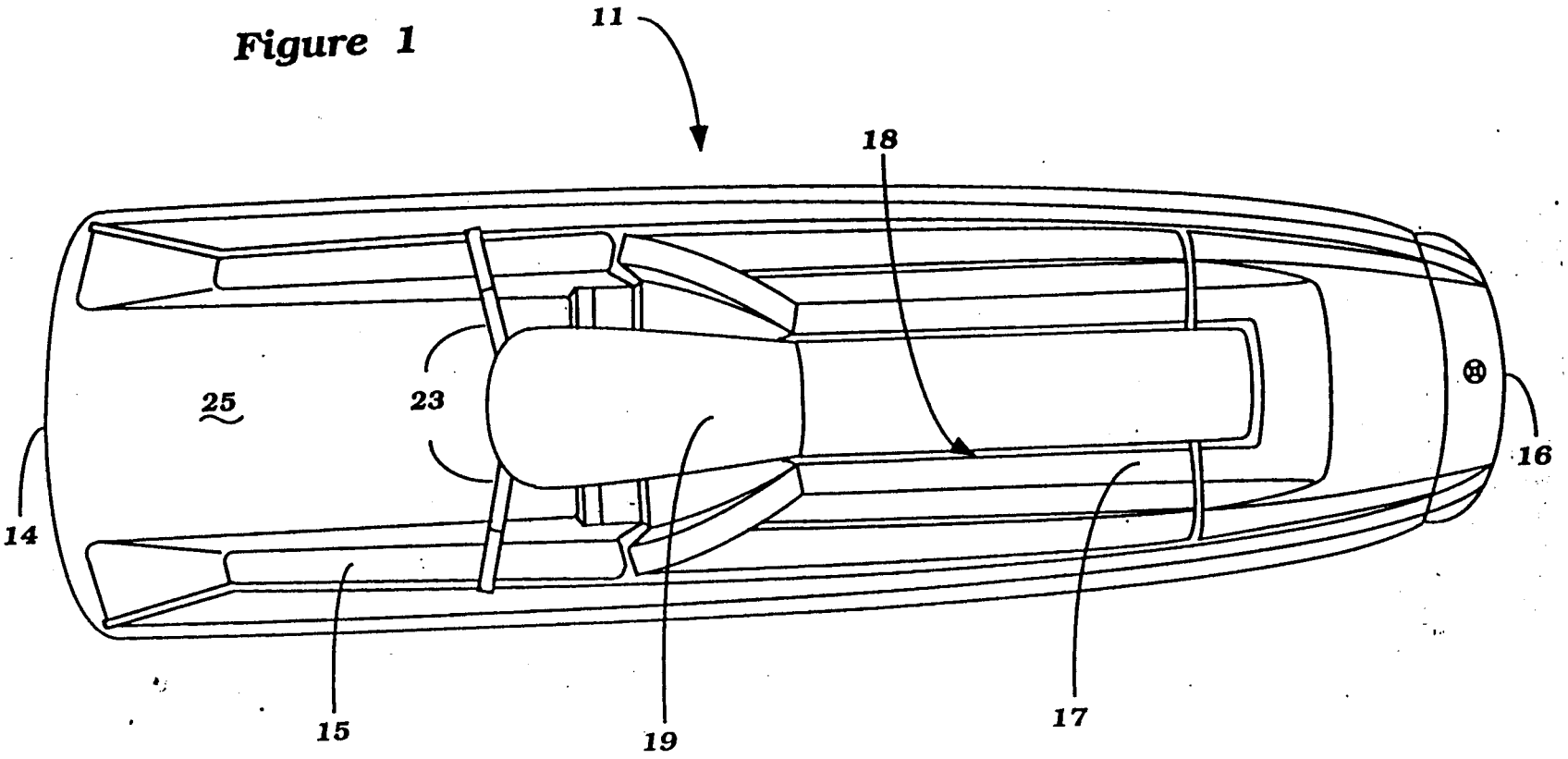
FIG. 1 is a top plan view of a small watercraft constructed in accordance with the invention.
Figure 2:
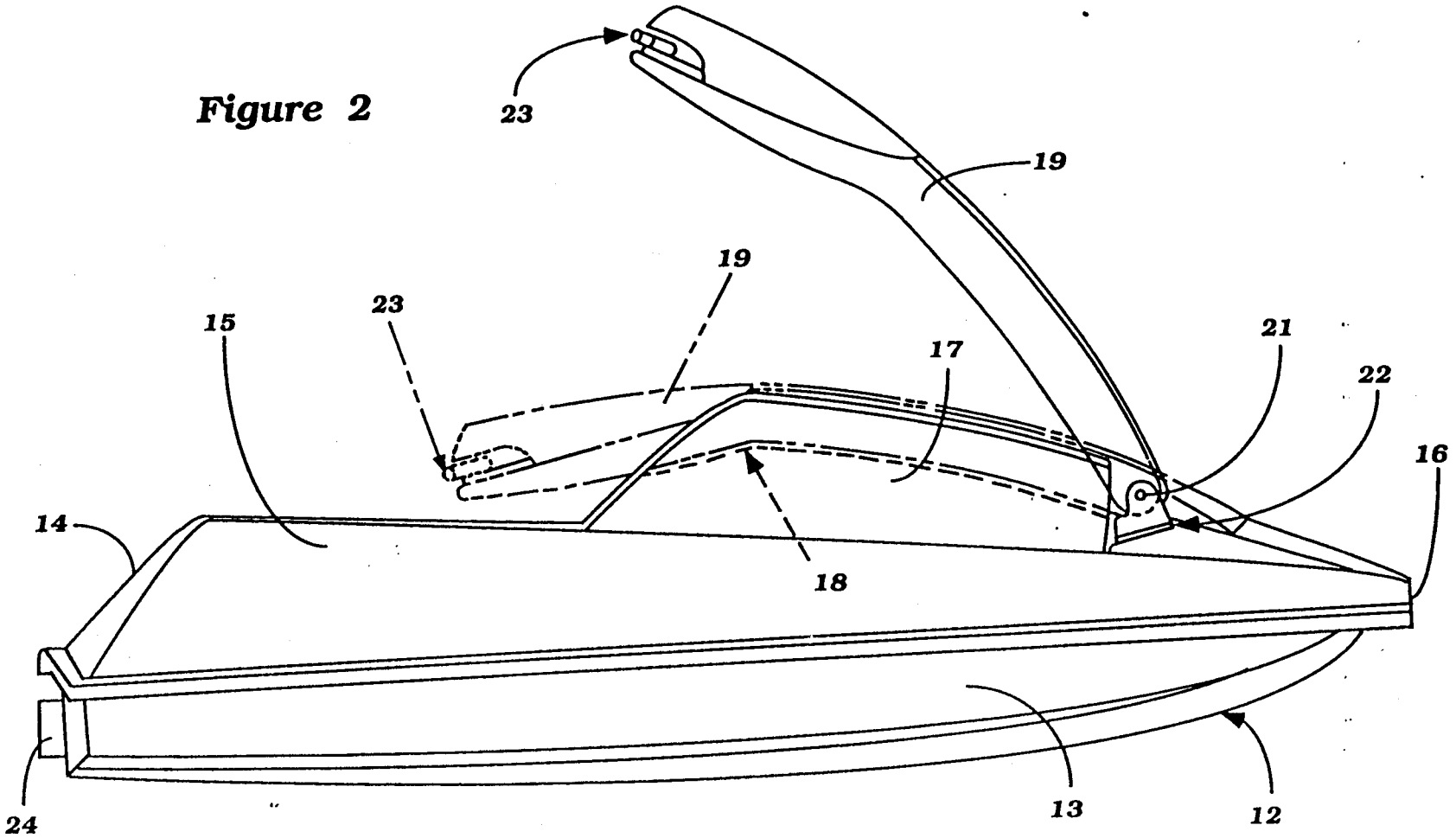
FIG. 2 is a side elevational view of the watercraft with the raisable steering mast shown pivoted to an upward and rearwardly extending position in solid lines and pivoted to a substantially horizontal lower position in dashed lines.

A small watercraft constructed in accordance with the invention is depicted in FIGS. 1 and 2 and is identified generally by the reference numeral 11. The small watercraft 11 is comprised of a hull 12 that has an elongated bottom portion 13 from which a stern 14 extends upwardly and preferably forwardly at a slight angle. Two laterally spaced side plates 15 also extend uPward from the bottom portion 13 and intersect at their forward ends to define a bow 16. The small watercraft 11 also includes a removeable hood 17 having two laterally spaced, longitudinally extending side walls which, at their rearward ends, merge into an upwardly and forwardly extending rear wall.

A raisable steering mast 19 is pivotally secured by a bolt 21 to a mounting 22. The mounting 22 has an elongated base 26, which is secured to the watercraft 11 forwardly of the hood 17, and a pair of upright members 27. The mounting 22 and its component parts are described in more detail in reference to FIGS. 3 through 6.

Steering means 23, preferably of the handlebar type, may be supported on the upper end of, or midway on, the steering mast 19. The steering means 23 is operatively connected to a steering mechanism (not shown) for steering the watercraft 11. Pivotal movement of the steering means 23 results in movement of a cable or rod (not shown) to pivot a steerable discharge nozzle 24 relative to the watercraft 11 for steering movement. The raisable steering mast 19, as best shown in FIG. 2, may be pivoted to a substantially horizontal lower position shown in dashed lines, or if desired, the steering mast 19 may be raised to an upward and rearwardly extending position shown in solid lines. A recessed portion 18 within the removable hood 17 is provided for retaining the raisable steering mast 19 when it is in its substantially horizontal lower position. The upward position will be used when the operator (not shown) is standing in an upright position on a horizontal platform in an operator space 25.

This operator space 25 is located rearwardly of the steering mast 19 and in proximity to the steering means 23 or handlebar for operation thereof. A raised deck portion defines the sides of the operator space 25. As may be seen in FIG. 1, the operator space 25 opens through the rear of the hull 12 so as to permit water flow from this area and to facilitate reentry of a displaced operator or rider.

The watercraft 11 is powered by an internal combustion engine (not shown) that is contained in the hull 12 beneath the hood 17 and raisable steering mast 19, and which drives a jet propulsion unit (not shown) that is disposed centrally of the hull 12 and beneath the operator space 25. This jet propulsion unit includes the steerable discharge nozzle 24 that is supported for pivotal movement about a generally extending vertical axis for steering of the watercraft 11 in a known manner. A control (not shown) for the engine is pivotally supported on the steering means or handlebar 23 and is connected to the appropriate portion of the engine by means of a cable.

The engine and its associated components are located forwardly of the operator space 25 such that when the watercraft 11 does not have an operator supported in the operator space 25, the bow 16 of the watercraft 11 will be submerged to a substantially greater depth than the stern 14 thereof. Due to this differential in submersion, the bow 16 being deeper, will offer greater resistance to the water than the stern 14 as the watercraft 11 is moved through the water. As a result, the watercraft 11 will tend to circle should the operator inadvertently displaced therefrom. Alternatively, the watercraft 11 may be equipped with a kill switch to turn off the engine in the event the operator is displaced from the space 25.

However, when an operator is on the horizontal platform in the operator space 25, the weight distribution of the watercraft 11 is changed so that the bow 16 extends upwardly out of the water so that the bow 16 is higher out of the water than the stern 14 to permit hydroplaning of the watercraft 11 when it is driven through the water by the engine and jet propulsion unit.

Figure 3:
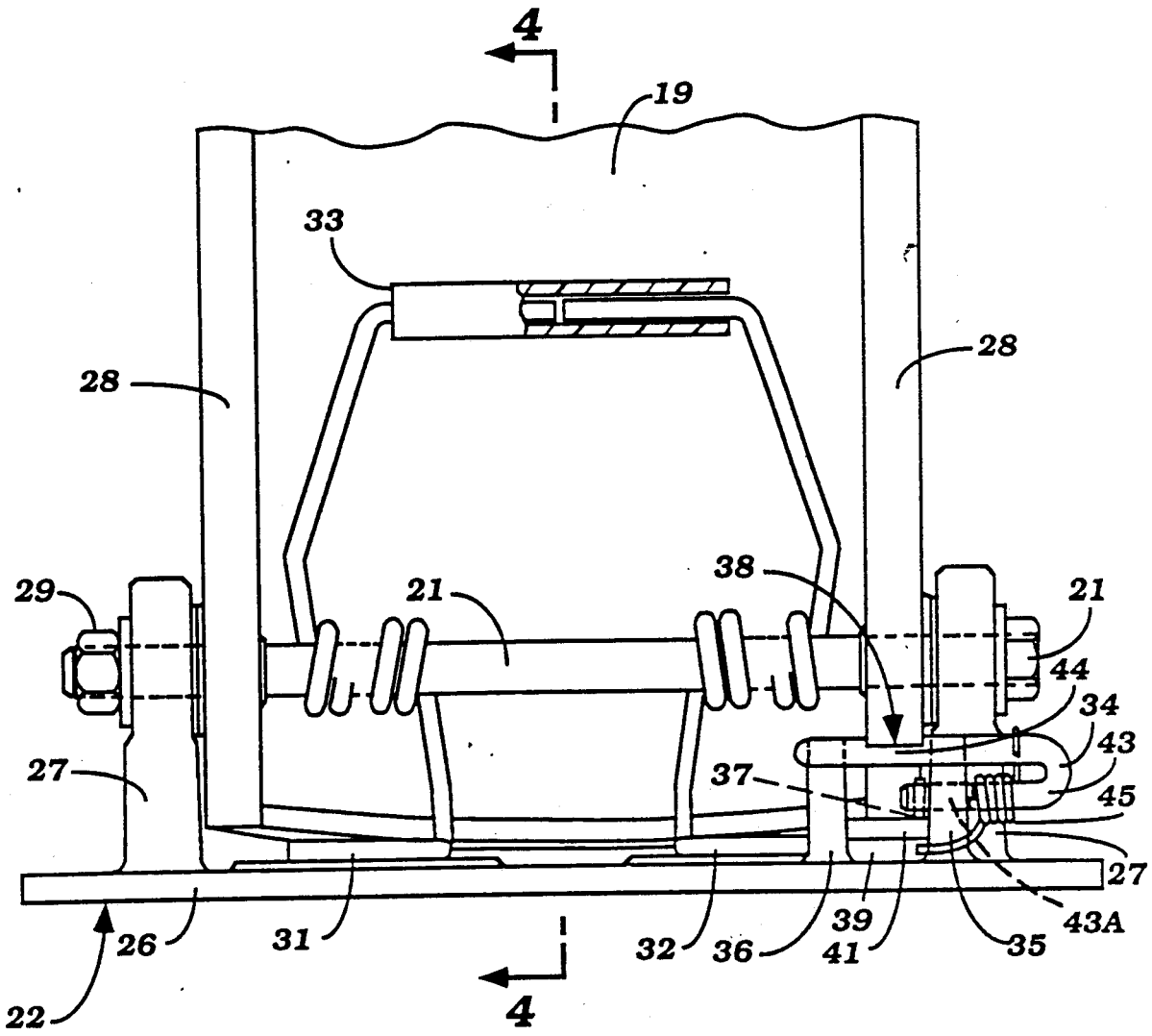
FIG. 3 is an enlarged view with parts cut away of the biasing means, mounting, locking means and the underside of the lower portion of the steering mast, showing the mast in its upright and locked position.
Figure 4:
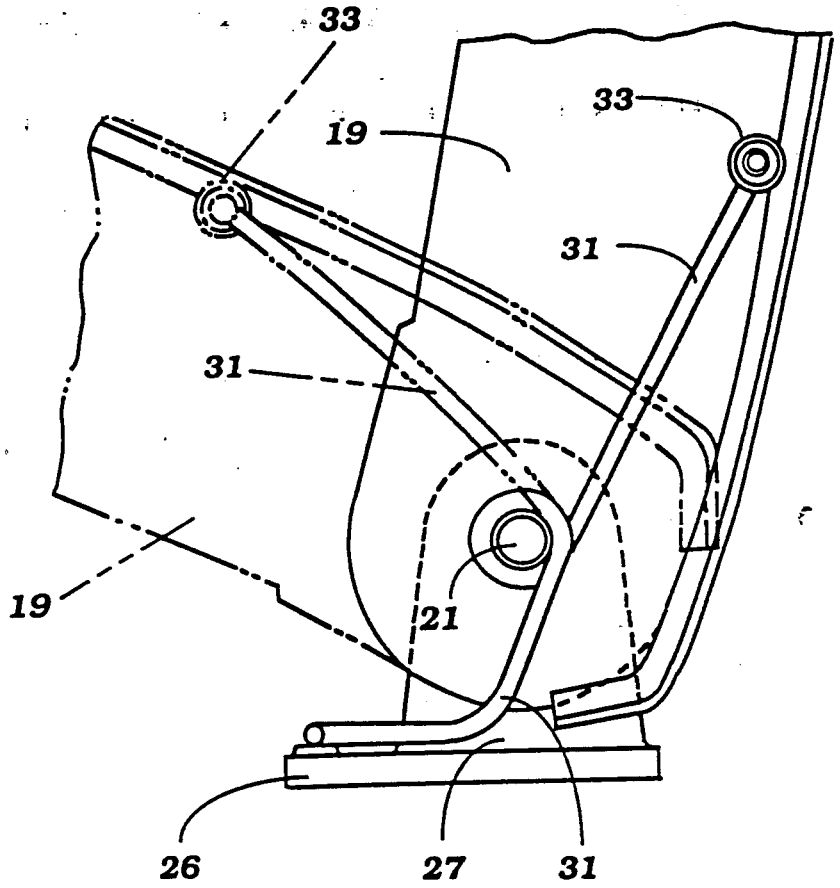
FIG. 4 is a cross-sectional view of FIG. 3 taken along lines IV—IV, showing the steering mast in its upright and locked position in solid lines and pivoted to a lower position in dashed lines.
Figure 5:
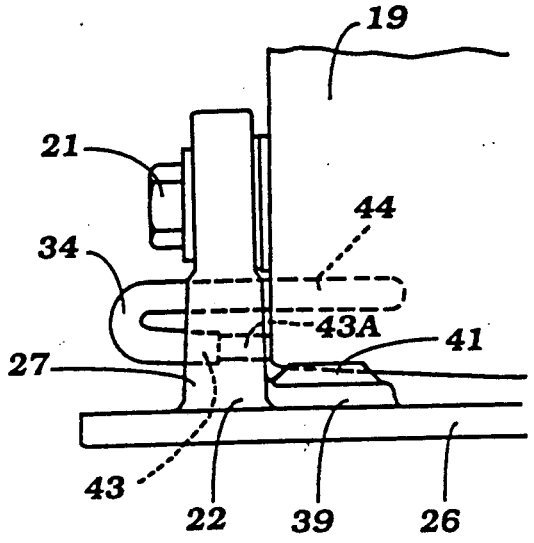
FIG. 5 is an enlarged front view showing parts of the steering mast, locking means and mounting.

Referring now to FIGS. 3, 4 and 5 the elongated base 26 of the mounting 22 is transversely secured to the hull 12 of the watercraft 11. The upright members 27 extend upward at opposite ends of the base 26 and have coaxial apertures therethrough for receiving the bolt 21. The raisable steering mast 19 includes side members 28 secured to the underside of the steering mast 19 along the longitudinal edges thereof. The side members 28 have coaxial apertures therethrough at the lower portion of the steering mast 19 for receiving bolt 21 journaled within the apertures for pivotal movement of steering mast 19 about this bolt 21 between an upward and rearwardly extending position and a substantially horizontal lower position during operation of the watercraft 11. The steering mast 19 may also be pivoted to an upright and locked position as hereinafter described for servicing the engine. A nut 29 is provided for securely maintaining the bolt 21 within the apertures so that the steering mast 19 is pivotally secured to the mounting 22.

In accordance with the invention, first and second torsional springs 31 and 32 are provided for biasing the steering mast 19 against the mounting 22. Each of the springs 31 and 32 has a lower end which is secured to the base 26 of the mounting 22 and a middle portion formed in the shape of a coil for receiving the bolt 21. The springs 31 and 32 are connected at their upper ends by a pad 33. The pad 33 is in the shape of a cylinder and has an aperture for receiving the upper ends of the springs 31 and 32, and thereby connecting them together. The pad 33 engages with the underside of the raisable steering mast 19. The springs 31 and 32 cooperate to assist in raising the steering mast 19 to an upward and rearwardly extending position during operation of the watercraft 11 and to its upright position wherein the steering mast 19 can be locked.

Locking means in the form of a U-shaped locking element 34 having parallel extending first and second ends 43 and 44 is provided for selectively locking the steering mast 19 in the upright position.

First and second lugs 35 and 36 are secured to the base 26, one on each side of one of the side members 28 of the steering mast 19. As shown in FIG. 3, the first lug 35 is positioned to the outside of the adjacent side member 28 and has an aperture therethrough perpendicular to the longitudinal axis of the watercraft 11. The lower portion 43A of the first end 43 of the U-shaped locking element 34 is of a smaller diameter for reception within the lug aperture to provide pivotal movement of the locking element 34 about a horizontal axis between a locked and unlocked position. A removable pin 37 positioned within an aperture at the tip of the lower portion 43A of the first end 43 of the locking element 34 prevents the locking element 34 from being inadvertently removed from the lug aperture.

The second end 44 of the locking element 34 is selectively engageable with a groove 38 in the side member 28 of the steering mast 19 adjacent to the lugs 35 and 36. To lock the steering mast 19 in its upright position, the steering mast 19 is raised to that position and the locking element 34 pivoted to its locked position wherein the second end 44 of locking element 34 is engaged with groove 38. When the steering mast 19 is locked in its upright position, the second end 44 of the locking element 34, in addition to being engaged with groove 38, is also engaged with the top portion of lugs 35 and 36, which act as stoppers for the locking element 34 when it is in the locked position. A torsional spring 45, having one end hooked to the second end 44 of the locking element 34, a middle portion coiled around the first end 43 of locking element 34 and the other end of the spring engaged with the first lug 35, can be used to releasably retain the locking element 34 in the unlocked position during normal operation of the watercraft 11.

There is a localized raised portion 39 extending upward from the base 26 of the mounting 22 located forwardly and between lugs 35 and 36, as shown in FIG. 3. A resilient pad 41 is secured to the raised portion 39 and is engageable with the lower end of one of the side members 28 when the raisable steering mast 19 is in its upright position. The resilient pad 41 provides a small force which urges the steering mast 19 rearward and toward a lower position to firmly engage the second end 44 of locking element 34 with groove 38 when the steering mast 19 is in the upright and locked position.

Figure 6:
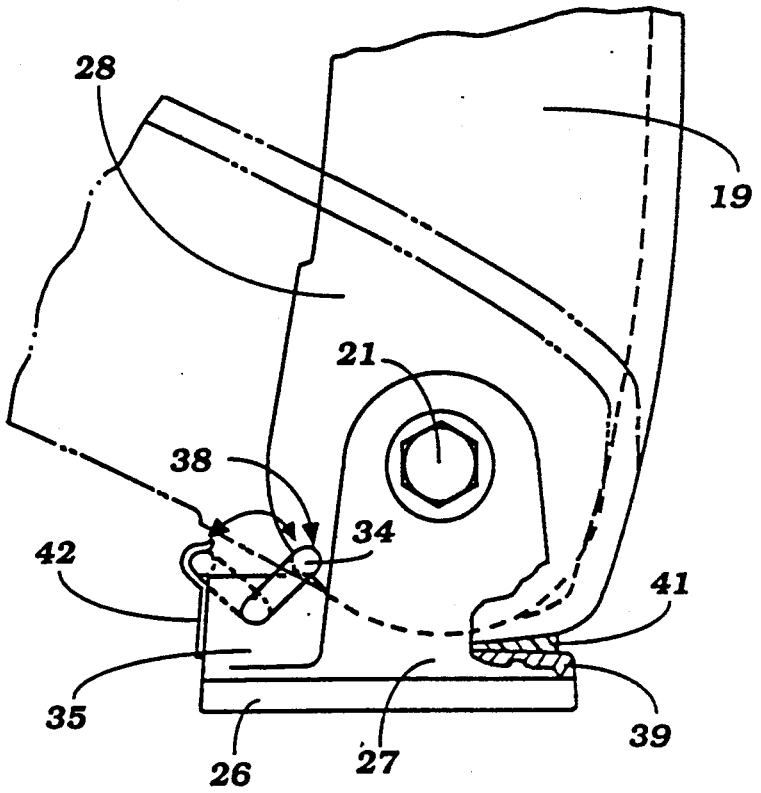
FIG. 6 is a side view of FIG. 3 with parts cut away showing a second embodiment of the invention which includes a keeper engageable with the locking means when the locking means and steering mast are in the unlocked position.

FIG. 6 illustrates a second embodiment of the invention which includes a keeper 42, instead of spring 45, secured to the first lug 35 to releasably retain the locking element 34 in the unlocked position. In this embodiment, the keeper 42 engages the second end 44 of the locking element 34 when the locking element 34 is pivoted to its unlocked position, as shown in dashed lines in FIG. 5.

Although two embodiments of the invention have been illustrated and described, various modifications may be made in said embodiments without departing from the spirit and scope of the invention, as defined by the appended claims. For example, the steering mast 19 can have nylon bushings to form the journal of the bolt 21 within the side member apertures, and either the side member apertures or the mounting apertures can be chamfered to facilitate alignment of the bolt 21 within the apertures, particularly when the steering mast 19 is in its substantially horizontal lower position. Also, a cotter key can be used instead of nut 29 to securely maintain the bolt 21 within the apertures.

We claim:

1. In a small watercraft comprising a hull having a stern, a bow, a horizontal platform and a removable hood that cooperatively define an operator space adjacent said stern to accommodate the operator, propulsion means carried by said hull for propelling said watercraft through the water including a steerable discharge nozzle mounted on said hull near said stern and an engine located forwardly of said operator space, said watercraft further comprising a mounting secured to said hull, a raisable steering mast having a lower portion pivotally connected to said mounting and an upper end, said steering mast being moveable between an upright position and a substantially horizontal lower position, steering means for steering said discharge nozzle associated with said steering mast and operable in an upward position of said steering mast by an operator standing in said operator space on said platform, the improvement comprising locking means pivotally connected to said mounting and engageable with the lower portion of said steering mast below where said steering mast is pivotally connected to said mounting for selectively locking said steering mast in said upright position for easy servicing of the engine.

2. In a small watercraft as recited in claim 1, wherein said a mounting member has an elongated base transversely secured to said hull and a pair of upright members, one at each end of said base, said upright members having coaxial apertures therethrough for receiving a bolt, said lower portion of said steering mast being pivotally connected to said mounting by said bolt.

3. In a small watercraft as recited in claim 2, wherein said locking means comprises a U-shaped locking element having a parallel extending first end pivotally connected to said mounting and a parallel extending second end engageable with said steering mast for locking said steering mast in said upright position for easy servicing of the engine.

4. In a small watercraft recited in claim 3, further comprising biasing means for biasing said steering mast against said hull to assist in raising said steering mast so that it can be locked in said upright position.

5. In a small watercraft as recited in claim 4, wherein said biasing means comprises at least one torsional spring secured to the base of said mounting and engageable with said steering mast.

6. In a small watercraft as recited in claim 5, wherein said steering mast further comprises side walls secured on the underside along the longitudinal edges of said steering mast, one of said side walls having a groove therein at the lower portion of said steering mast and engageable with said second end of said U-shaped locking element.

7. In a small watercraft as recited in claim 6, further comprising a first lug having an aperture therethrough for receiving the first end of said locking element, so that said locking element can pivot about a horizontal axis between a locked and unlocked position, the second end of said U-shaped element being engageable with the groove of said steering mast when said U-shaped locking element is in said locked position for locking said steering mast in said upright position.

8. In a small watercraft as recited in claim 7, further comprising a keeper secured to said first lug and engageable with the second end of said U-shaped locking element when said U-shaped locking element is in the unlocked position.

9. In a small watercraft comprising a hull having a stern, a bow, a horizontal platform and a removeable hood that cooperatively define an operator space adjacent said stern to accommodate the operator, propulsion means carried by said hull for propelling said watercraft through the water including a steerable discharge nozzle mounted on said hull near said stern and an engine located forwardly of said operator space, said watercraft further comprising a mounting secured to said hull, a raisable steering mast having a lower portion pivotally connected to said mounting and an upper end, said steering mast being moveable between an upright position and a substantially horizontal lower position, steering means for steering said discharge nozzle associated with said steering mast and operable in an upward position of said steering mast by an operator standing in said operator space on said platform, the improvement comprising locking means pivotally connected to said mounting for selectively locking said steering mast in said upright position, and a resilient pad secured to said mounting and engageable with the lower end of said steering mast so as to urge said steering mast rearward and toward a lower position to firmly engage said locking means with said steering mast when the steering mast is in the upright and locked position.

10. In a small watercraft comprising a hull having a stern, a bow, a horizontal platform and a removeable hood that cooperatively define an operator space adjacent said stern to accommodate the operator, propulsion means carried by said hull for propelling said watercraft through the water including a steerable discharge located forwardly of said operator space, said watercraft further comprising a mounting secured to said hull, a raisable steering mast having a lower portion pivotally connected to said mounting and an upper end, said steering mast being moveable between an upright position and a substantially horizontal lower position, steering means for steering said discharge nozzle associated with said steering mast and operable in an upward position of said steering mast by an operator standing in said operator space on said platform, the improvement comprising locking means pivotally connected to said mounting for selectively locking said steering mast in said upright position, and biasing means for biasing said steering mast against said hull to assist in raising said steering mast so that it can be locked in said upright position.

11. In a small watercraft as recited in claim 1, wherein said steering mast is prevented from returning rearwardly to said substantially horizontal lower position when said steering mast is in the locked and upright position.

* * * * *

UNITED STATES PATENT AND TRADEMARK OFFICE

CERTIFICATE OF CORRECTION

PATENT NO. : 4,989,532

DATED : February 5, 1991

INVENTOR(S) : Kishi, et al

It is certified that error appears in the above-identified patent and that said Letters Patent is hereby corrected as shown below:

Column 6, lines 46-47, Claim 10, after "discharge" insert --nozzle mounted on said hull near said stern and an engine--.

Signed and Sealed this

Twentieth Day of April, 1993

*Attest:*

MICHAEL K. KIRK

*Attesting Officer*

*Acting Commissioner of Patents and Trademarks*